US010158169B1

(12) United States Patent
Venghaus et al.

(10) Patent No.: US 10,158,169 B1
(45) Date of Patent: Dec. 18, 2018

(54) MOBILE ANTENNA SYSTEM

(71) Applicant: Winegard Company, Burlington, IA (US)

(72) Inventors: Brent Lee Venghaus, Mount Pleasant, IA (US); Reed Alan Wagenbach, Burlington, IA (US); Jared David Schmidgall, Mediapolis, IA (US)

(73) Assignee: Winegard Company, Burlington, IA (US)

( * ) Notice: Subject to any disclaimer, the term of this patent is extended or adjusted under 35 U.S.C. 154(b) by 0 days.

(21) Appl. No.: 15/666,329

(22) Filed: Aug. 1, 2017

(51) Int. Cl.
*H01Q 1/42* (2006.01)
*H01Q 1/08* (2006.01)

(52) U.S. Cl.
CPC ..... *H01Q 1/428* (2013.01); *H01Q 1/088* (2013.01)

(58) Field of Classification Search
CPC ..... H01Q 1/42; H01Q 1/428
See application file for complete search history.

(56) References Cited

U.S. PATENT DOCUMENTS

| | | | | |
|---|---|---|---|---|
| 2,688,170 | A | 9/1954 | Balzer | |
| 3,028,993 | A | 4/1962 | Muhlhoff | |
| 4,099,304 | A | 7/1978 | Luc | |
| 4,804,972 | A * | 2/1989 | Schudel | H01Q 1/42 343/840 |
| 5,720,086 | A | 2/1998 | Eliasson et al. | |
| 5,743,439 | A | 4/1998 | Semenenko | |
| 5,788,399 | A | 8/1998 | Smearsoll | |
| 6,065,920 | A | 5/2000 | Becker et al. | |
| 6,435,576 | B1 | 8/2002 | Kusta | |
| 6,507,324 | B2 | 1/2003 | Overton et al. | |
| 6,623,013 | B1 | 9/2003 | Lee | |
| 7,006,054 | B2 | 2/2006 | Rosenfeld et al. | |
| 7,042,407 | B2 * | 5/2006 | Syed | H01Q 1/42 343/705 |
| 7,161,553 | B2 | 1/2007 | Courtney | |
| 71,951,313 | | 3/2007 | Bryant | |
| 7,868,845 | B2 | 1/2011 | Gratton et al. | |
| 8,602,245 | B2 | 12/2013 | Manahan | |
| 8,860,626 | B2 | 10/2014 | Renilson et al. | |
| 9,050,692 | B2 | 6/2015 | Wright et al. | |
| 9,350,066 | B2 | 5/2016 | Moreau et al. | |
| 9,577,323 | B2 | 2/2017 | Renilson et al. | |
| 9,583,822 | B2 | 2/2017 | Curran et al. | |
| 2013/0002515 | A1 | 1/2013 | Hills et al. | |
| 2015/0152988 | A1 | 6/2015 | Butkus et al. | |
| 2016/0294050 | A1 | 10/2016 | Renilson et al. | |

FOREIGN PATENT DOCUMENTS

| | | | |
|---|---|---|---|
| EP | 2700862 | A1 | 2/2014 |

* cited by examiner

*Primary Examiner* — Hoang Nguyen
(74) *Attorney, Agent, or Firm* — Dorr, Carson & Birney PC

(57) ABSTRACT

A mobile antenna system has a dome with an internal space for enclosing an antenna, and tabs spaced around and extending outward from the circular edge of the dome. A base supports the antenna and includes a side wall extending upward to define a circular edge abutting the edge of the dome. Tabs are spaced around and extend outward from the circular edge of the base in vertical alignment to contact the tabs of the dome. The dome and base are removably secured together by a locking ring having an inner diameter large enough to fit over the edges of the dome and base. This ring has a set of L-shaped slots, each having a vertical slot segment with a width to receive the aligned tabs, and a horizontal slot segment continuing from the vertical slot segment.

14 Claims, 7 Drawing Sheets

MOBILE ANTENNA SYSTEM

BACKGROUND OF THE INVENTION

Field of the Invention

The present invention relates generally to the field of mobile antenna systems. More specifically, the present invention discloses a mobile antenna system with a base and dome containing the antenna, and a locking ring to removably secure the dome to the base.

Statement of the Problem

A wide variety of mobile antenna systems have been used for many years. Particularly with satellite antennas and other mobile antennas that require a positioning system to point the antenna in a particular direction, the antenna and its positioning system are often housed within a dome structure for protection against damage and the elements. One approach has been to mount the antenna and its positioning system to a base that can be removably secured to a dome to define a structure with an internal chamber that completely encloses the antenna and positioning system. Typically, only cables for power, communications and control extend from this assembly.

A balancing of interests should be considered in designing the assembly of the dome and base. Ideally, trained personnel should be able to quickly and easily assemble and disassemble the mobile antenna system using only basic tools. The antenna system should only require a minimal number of loose parts and fasteners that can become lost. The assembled antenna system should also rugged. These antenna systems are commonly used by the military and in the oil/gas industry in hostile environments, and can be subject to abuse in the field. The antenna system should also provide a degree of security to deter at least casual efforts at disassembly by people who aren't trained personnel.

Solution to the Problem

The present invention addresses these concerns of the prior art by providing an mobile antenna system with a locking ring to removably secure the dome to the base. This provides a quick, simple, one-piece means for assembling and disassembling the present antenna system. The optional locking protrusion provides enhanced security against casual tampering personnel. But, trained personnel can still easily assemble and disassemble the antenna system.

SUMMARY OF THE INVENTION

This invention provides a mobile antenna system having a dome with an internal space for enclosing an antenna. Tab are spaced around and extend outward from the circular edge of the dome. A base supports the antenna and includes a side wall extending upward to define a circular edge abutting the edge of the dome. Tabs are also spaced around and extend outward from the circular edge of the base in vertical alignment to contact the tabs of the dome. The dome and base are removably secured together by a ring having an inner diameter large enough to fit over the edges of the dome and base. This ring has a series of L-shaped slots, each having a vertical slot segment with a width to receive the aligned tabs, and a horizontal slot segment continuing from the vertical slot segment.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
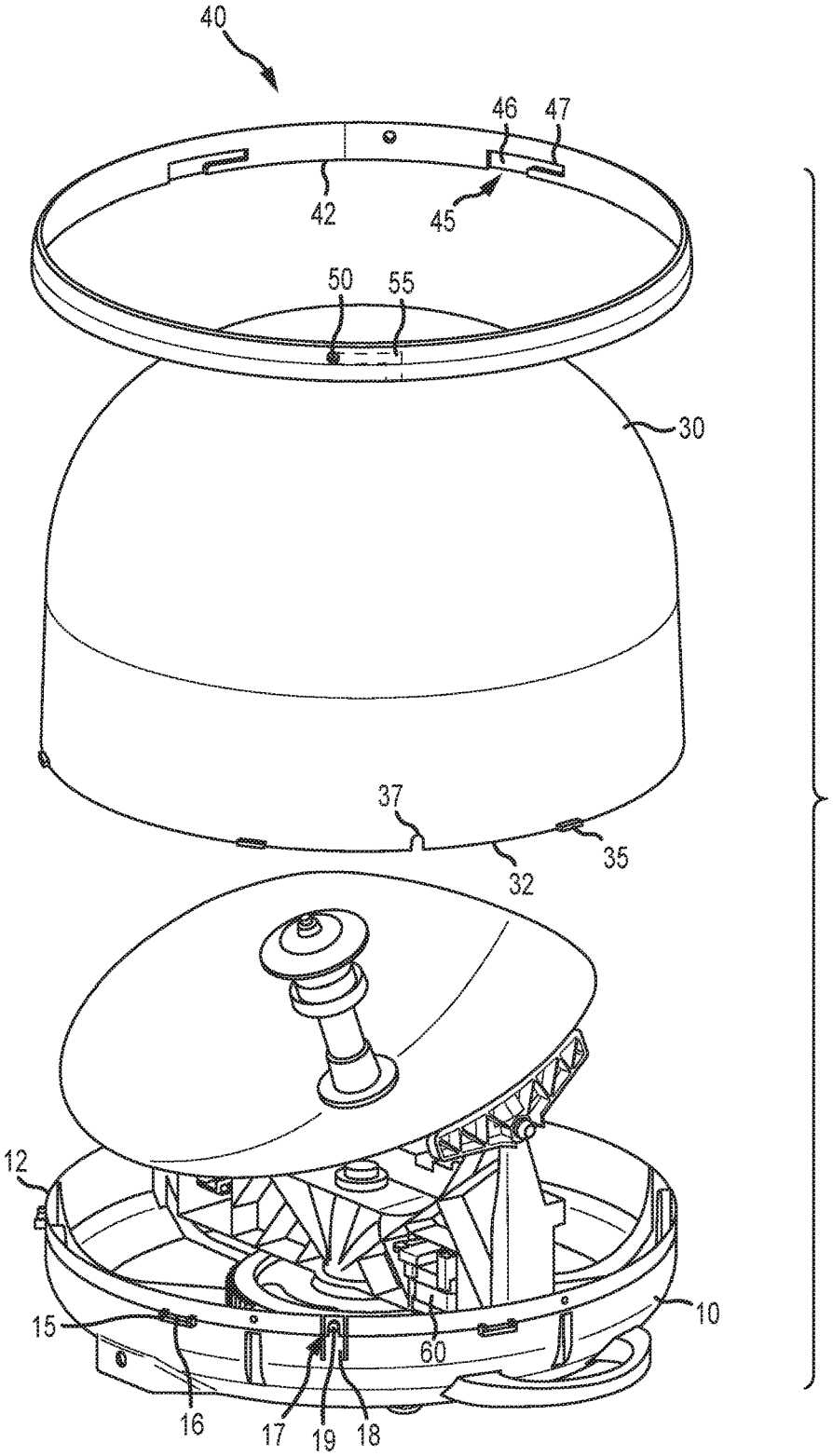
FIG. 1 is an exploded top axonometric view of an embodiment of the present invention.
Figure 2:
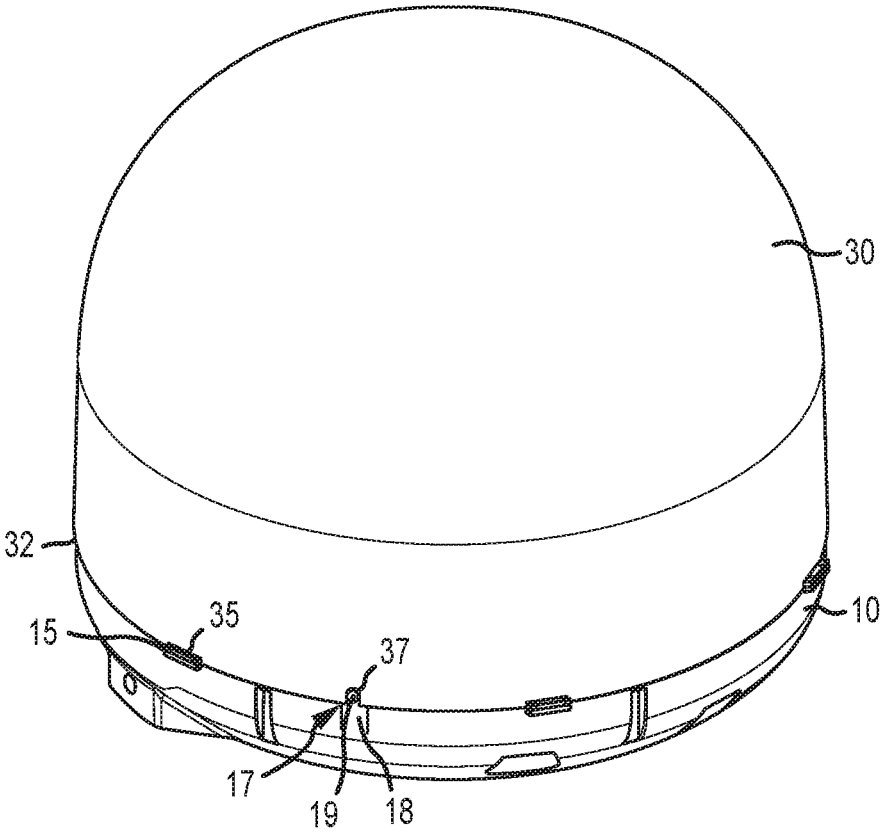
FIG. 2 is a top axonometric view of the assembled dome 30 and base 10.

Turning to FIG. 1, an exploded top axonometric view is shown of an embodiment of the present invention. The major component include a base 10 supporting an antenna 20 within the interior space defined by a removable dome 30. The base 10 has a side wall that extends upward to a generally circular upper edge 12 abutting the generally circular lower edge 32 of the dome 30. The edges 12, 32 may overlap to a degree to help ensure a better seal or better alignment between the dome 30 and base 10, but their edges 12, 32 should still be construed as "abutting" one another. The antenna 20 and its positioning system are typically secured to the interior floor of the base 10. When assembled, the dome 30 and base 10 define an interior space that completely encloses the antenna 20 and its positioning system. FIG. 2 is a top axonometric view of the assembled dome 30 and base 10.

As shown in FIGS. 1 and 4, a set of tabs 15 are spaced around and extending outward from the upper edge 12 of the base 10. Similarly, another set of tabs 35 are spaced around and extend outward from the lower edge 32 of the dome 30. These sets of tabs 15, 35 are vertically aligned, so that each base tab 15 is aligned with, and comes into contact with a corresponding dome tab 35 when the dome 30 and base 10 are assembled as depicted in FIGS. 2 and 4.

Figure 4A:
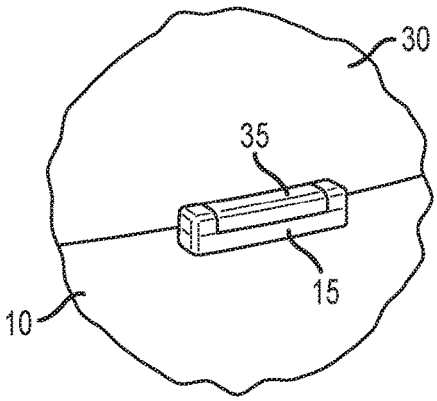
FIG. 4A is a detail axonometric view of the aligned tabs 35, 15 of the dome 30 and base 10.
Figure 4B:
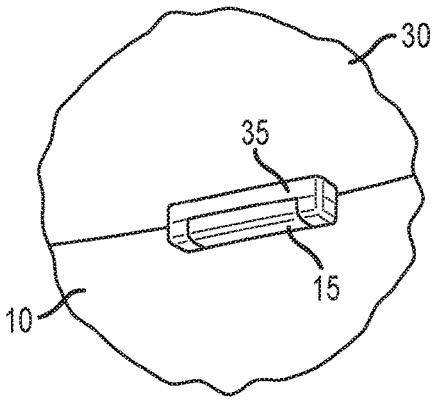
FIG. 4B is a detail axonometric view of an alternative embodiment of the aligned tabs 35, 15 in which the tab 15 extending from the base 10 nests into a detent in the tab 35 on the dome 30.

Optionally, the tabs 15 on the base 10 can include detents 16 for nesting with the tabs 35 on the dome 30, as illustrated in FIG. 4A. This can help ensure more accurate alignment between each pair of tabs 15, 35. Alternatively FIG. 4B shows an another embodiment of the aligned tabs 15, 35 in which the base tabs 15 nest into detents in the dome tabs 35.

Figure 3:
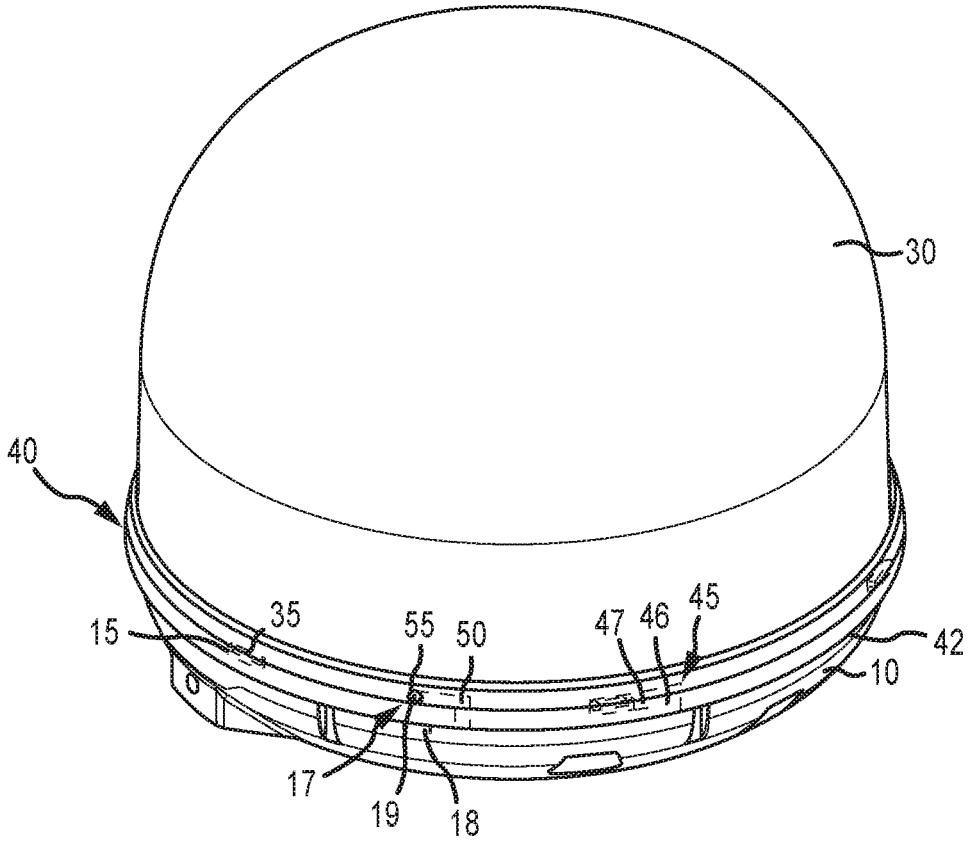
FIG. 3 is a top axonometric view of the assembled dome 30, base 10 and locking ring 40.
Figure 5:
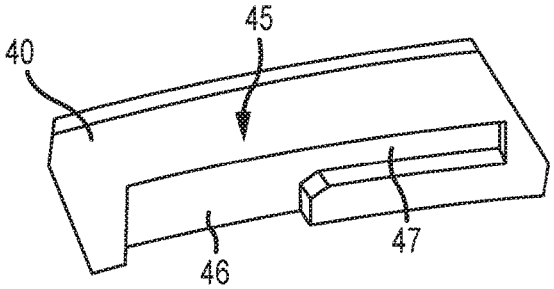
FIG. 5 is a detail view of an L-shaped tab slot 45 in the locking ring 40.

A locking ring 40 removably secures the dome 30 to the base 10 as shown in FIG. 3. The ring 40 has a generally circular shape with an inner diameter large enough to fit over the dome 30 and/or base 10. In particular, the ring 40 fits over the edges 12, 32 of the base 10 and dome 30. The ring 40 has a set of substantially L-shaped tab slots 45 spaced at intervals around the interior surface of the ring 40 for removably engaging the aligned tabs 15, 35 on the base 10 and dome 30. FIG. 5 is a detail side view of an L-shaped tab slot 45. Each L-shaped tab slot has a vertical slot segment 46 with a width to receive a pair of aligned tabs 15, 35. A horizontal slot segment 47 continues from the vertical slot segment 46. Optionally, at least some of the horizontal slot segments 47 have a height to removably engage or grip the aligned tabs 15, 35 and thereby removably secure the dome 30 to the base 10.

Figure 6A:
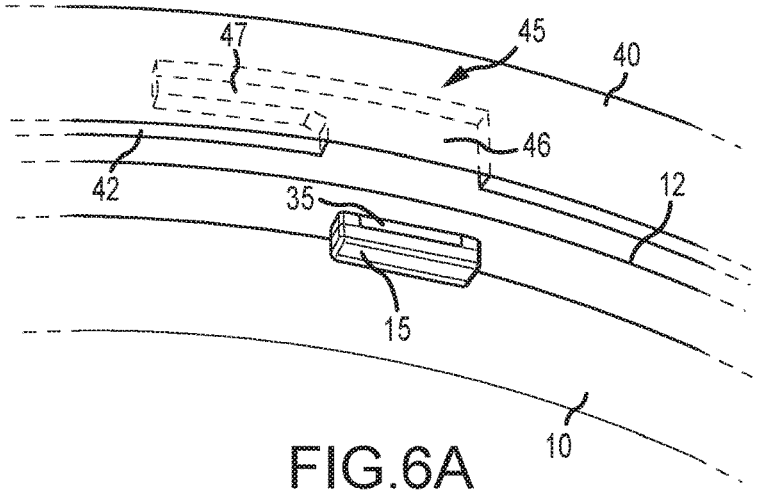
FIGS. 6A-6C are detail views of the aligned tabs 35, 15 moving in an L-shaped tab slot 45.
Figure 6B:
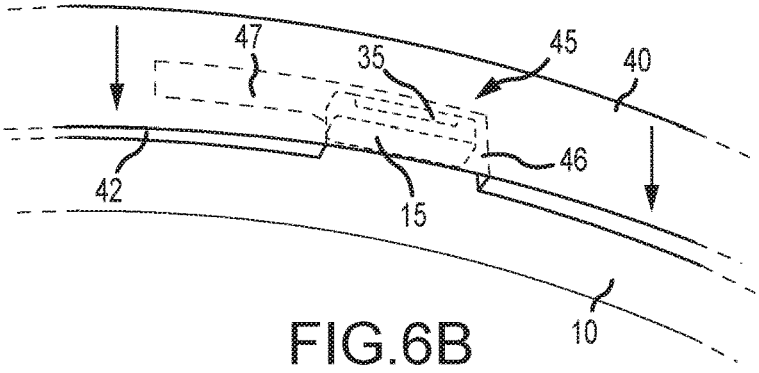
Figure 6C:
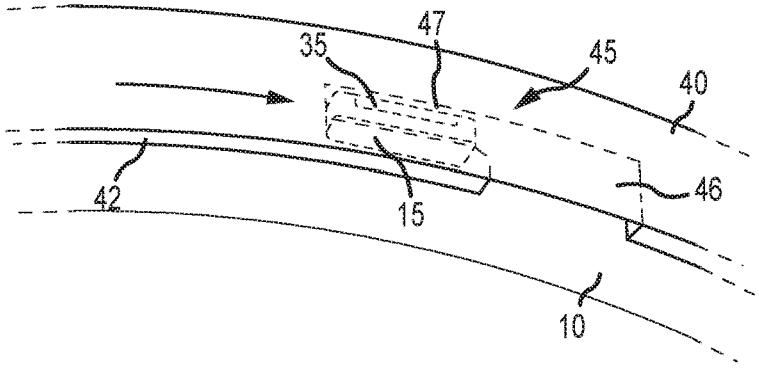

FIGS. 6A-6C are detail views of a pair of aligned tabs 35, 15 moving in an L-shaped tab slot 45. In summary, the ring 40 is placed over the dome and oriented so that each vertical slot segment 46 is vertically aligned with a pair of tabs 15, 35 as illustrated in FIG. 6A. The ring 40 can then be moved downward so that the tabs 35, 15 slide upward to the top the vertical slot segments 46 of the L-shaped tab slots 45, as shown in FIG. 6B. The ring 40 can then be rotated horizontally (i.e., rotated about a vertical axis) to a degree to cause the tabs 35, 15 to slide along the horizontal slot segments 47 of the L-shaped tab slots 45, as depicted in FIG. 6C. Optionally, the reduced height of the horizontal slot segments 47 grips or engages the tabs 35, 15 (e.g., by a frictional grip) and thereby holds the ring 40 in place on the tabs 35, 15.

The embodiment shown in the accompanying drawings employs a ring 40 that fits downward over the dome 30 until the lower edge 42 of the ring 40 covers the upper edge 12 of the base. Here, the vertical slot segments 45 of the L-shaped tab slot 45 extend upward from the lower edge 42 of the ring. Alternatively, the ring 40 could fitted upward over the base 10, with the vertical slot segments 46 of the L-shaped tab slots 45 extending downward from the upper edge of the ring 40.

Figure 7:
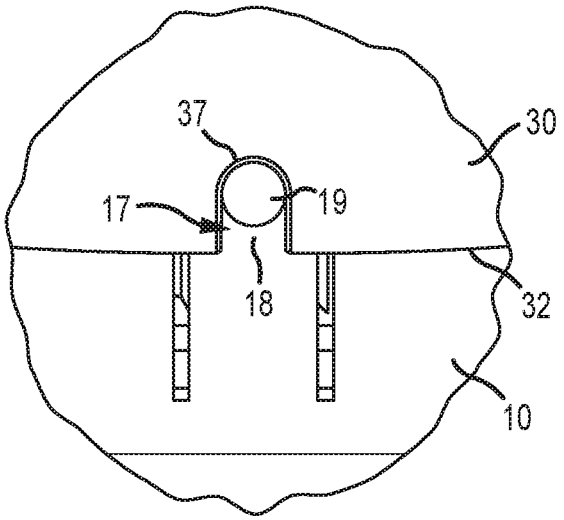
FIG. 7 is a detail side view of the locking protrusion 17 extending upward from the base 10 and the alignment recess 37 in the edge of the dome 30.
Figure 8:
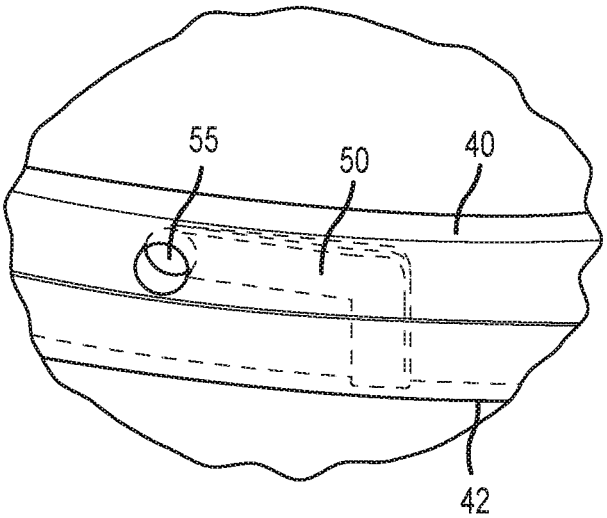
FIG. 8 is a detail view of the L-shaped locking slot 50.

Optionally, the present invention can be equipped with additional features to help ensure proper alignment of the dome 30 on the base 10, and provide a locking mechanism for the ring 40, as illustrated for example in FIGS. 7-9. In this embodiment, a locking protrusion 17 extends upward from the upper edge of the base 10 to seat in a corresponding alignment recess 37 in the edge of the dome 30 and ensure proper alignment of the dome 30 on the base 10. Preferably, the locking protrusion 17 includes a vertical segment 18 extending upward from the edge of the base 10, and a button 19 extending outward from the upper end of the vertical segment 18. Alternatively, the locking protrusion 17 could extend downward from the dome 30 to seat in a corresponding alignment recess in the upper edge 12 of the base 10.

FIG. 8 is a detail view of the L-shaped locking slot 50 on the interior surface of the ring 40 that engages the button 19 on the locking protrusion 17. This L-shaped locking slot 50 also has vertical and horizontal slot segments similar to the L-shaped tab slots 45 discussed above. But, the L-shaped locking slot 50 has dimensions allowing the button 19 to slide freely along both of its slot segments. A hole 55 at the distal end of the horizontal slot segment of the L-shaped locking slot 50 has a diameter sufficiently large for the button 19 to seat itself in the hole 55 and thereby lock the ring 40 in place. The hole 55 passes through the ring 40 to the exterior, so the head of the button 19 is exposed. This allows a user to exert manual pressure through the hole 55 on the head of the button 19 to release the button 19 from the hole 55, and thereby unlock the ring 40 so that it can be removed.

Figure 9A:
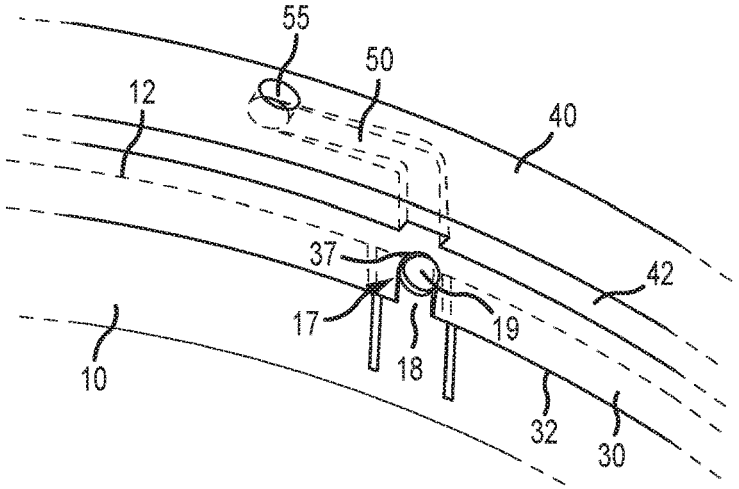
FIGS. 9A-9C are a detail views of the locking protrusion 17 moving in the L-shaped locking slot 50.
Figure 9B:
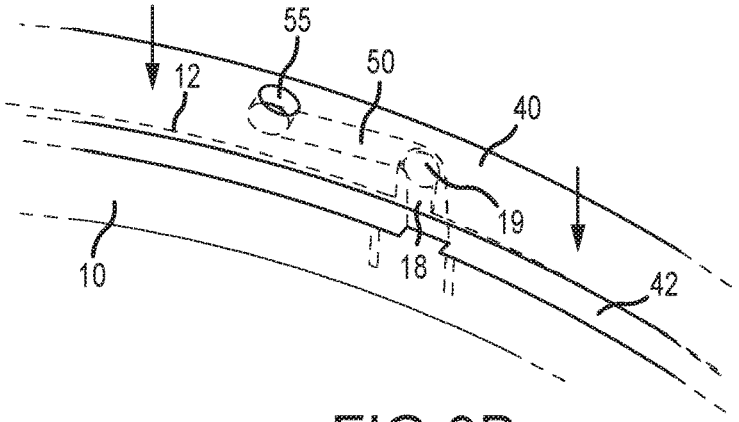
Figure 9C:
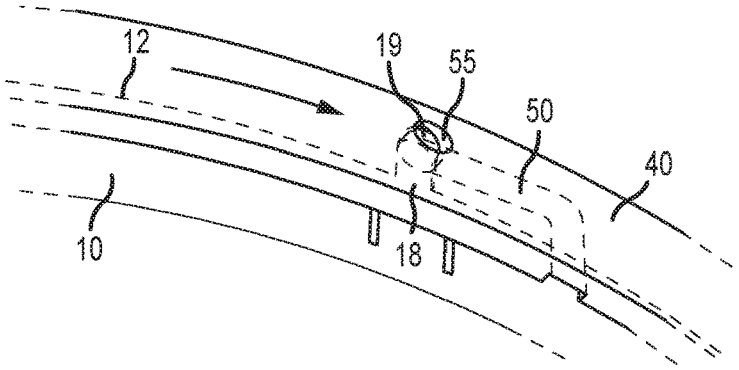

FIGS. 9A-9C are detail views of the button 19 of the locking protrusion 17 moving along the L-shaped locking slot 50. It should be understood that the locking protrusion 17 and L-shaped locking slot 50 are designed so that their functionalities are fully integrated with, and complementary to those of the tabs 35, 15 and L-shaped tab slots 45. All of these components are aligned and dimensioned so properly aligning the dome 30 on the base 10, and then placing the ring 40 over the dome 40 in alignment with the tabs 35, 15 will result in alignment of the locking protrusion 17 with the recess 37 in the dome 30, and will also result in alignment of the button 19 with the vertical segment of L-shaped locking slot 50. Once everything is initially aligned with the locking protrusion 17 seated in the recess 37 in the dome 30, the user can move the ring 40 downward so that the tabs 35, 15 slide upward to the top the vertical slot segments 46 of the L-shaped tab slots 45, and the button 19 slides to the top of the vertical slot segment of the L-shaped locking slot 50. The ring 40 can then be rotated horizontally (i.e., rotated about a vertical axis) to a degree to cause the aligned tabs 35, 15 to slide along the horizontal slot segments 47 of the L-shaped tab slots 45, while the button 19 slides along the horizontal slot segment of the L-shaped locking slot 50 until the button 19 locks into the hole 55. Optionally, the horizontal slot segments 47 of the L-shaped tab slots can also grip the tabs 35, 15 (as previously discussed) to help hold the ring 40 in place on the tabs 35, 15.

The procedure for unlocking the ring 40 is largely the reverse of that outlined above. However, the user must first release the button 19 of the locking protrusion 17 from the hole 55 in the L-shaped locking slot 50 by exerting manual pressure through the hole 55 on the button 19. This causes the vertical segment 18 of the locking protrusion to deflect inward and withdraws the button 19 from the hole 55. The user can then rotate the ring 40 slightly in the opposite direction to slide the tabs 35, 15 and button 55 to the other end of their respective horizontal slot segments, so that these components are at the upper ends of their respective vertical slot segments. At that point, the user can lift the ring 40 vertically upward to disengage the tabs 35, 15 from the L-shaped tab slots 45 and disengage the button 19 from the L-shaped locking slot 50. The ring 40 can be completely removed from the dome 30, and the dome 30 can be removed from the base 10 to provide access to the antenna 20 and its positioning system.

Optionally, the locking ring 40 and base 10 can be equipped with holes that align when the dome 30, base 10 and ring 40 are properly assembled. A screw, bolt, pin or other fastener can then be inserted into the aligned holes to help ensure proper assembly and removably secure the locking ring 40 to the base.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A mobile antenna system comprising:

an antenna;

a dome having an internal space, a circular lower edge, and tabs spaced around and extending outward from the edge of the dome;

a base supporting the antenna within the dome and having:

(a) a side wall extending upward to define a circular upper edge abutting the lower edge of the dome; and (b) tabs spaced around and extending outward from the upper edge of the base, said tabs being vertically aligned to contact the tabs of the dome;

a ring with an inner diameter to fit over the edges of the dome and base, said ring having an interior surface with substantially L-shaped tab slots for removably engaging the tabs on the dome and base to thereby removably secure the dome to the base; each L-shaped tab slot having a vertical slot segment with a width to receive the aligned tabs of the dome and base, and a horizontal slot segment continuing from the vertical slot segment.

2. The mobile antenna system of claim 1 wherein the tabs on the base further comprise detents for aligning with the tabs on the dome.

3. The mobile antenna system of claim 1 wherein the tabs on the dome further comprise detents for aligning with the tabs on the base.

4. The mobile antenna system of claim 1 wherein the ring has an inner diameter to fit over the dome and further comprises a lower edge fitting over the edges of the dome and base, and wherein said vertical slot segments extend upward from the lower edge of the ring.

5. The mobile antenna system of claim 1 wherein at least one of the horizontal slot segments of the L-shaped tab slots have a height to removably engage the aligned tabs.

6. The mobile antenna system of claim 1 wherein the ring includes a hole and the side wall of the base includes a hole that align when the L-shaped tab slots engage the tab, and further comprising a fastener insertable through the aligned holes to thereby removably secure the ring and dome to the base.

7. The mobile antenna system of claim 1 further comprising:

a locking protrusion extending upward and outward from the upper edge of the base;

an alignment recess in the lower edge of the dome receiving the locking protrusion; and a substantially L-shaped locking slot on the interior surface of the ring engaging the locking protrusion.

8. The mobile antenna system of claim 7 wherein the locking protrusion further comprises:

a vertical segment extending upward from the upper edge of the base; and a button extending outward from the upper end of the vertical segment.

9. The mobile antenna system of claim 7 wherein the L-shaped locking segment further comprises:

a vertical slot segment extending upward from the lower edge of the ring on the interior surface of the ring and allowing the locking protrusion to slide along the vertical slot segment;

a horizontal slot segment continuing from the vertical slot segment on the interior surface of the ring and allowing the locking protrusion to slide along the horizontal slot segment; and a hole extending from the horizontal slot segment through the ring for engaging the locking protrusion, wherein the locking protrusion can be disengaged from the hole by manual pressure exerted through the hole on the locking protrusion.

10. A mobile antenna system comprising:

an antenna;

a dome having an internal space, a circular lower edge, and tabs spaced around and extending outward from the edge of the dome;

a base supporting the antenna within the dome and having:

(a) a side wall extending upward to define a circular upper edge abutting the lower edge of the dome;

(b) tabs spaced around and extending outward from the upper edge of the base, said tabs being vertically aligned to contact the tabs of the dome; and (c) a locking protrusion extending outward from the base; and a ring having:

(a) an interior surface with an inner diameter to fit over the dome;

(b) a lower edge fitting over edges of the dome and base;

(c) substantially L-shaped tab slots on the interior surface of the ring for removably engaging the tabs on the dome and base to thereby removably secure the dome to the base; each L-shaped tab slot having a vertical slot segment extending upward from the lower edge of the ring with a width to receive the aligned tabs of the dome and base, and a horizontal slot segment continuing from the vertical slot segment; and (d) a substantially L-shaped locking slot on the interior surface of the ring for engaging the locking protrusion to thereby lock the ring to the dome and base.

11. The mobile satellite antenna of claim 10 wherein the L-shaped locking slot further comprises:

a vertical slot segment extending upward from the lower edge of the ring on the interior surface of the ring and allowing the locking protrusion to slide along the vertical slot segment;

a horizontal slot segment continuing from the vertical slot segment on the interior surface of the ring and allowing the locking protrusion to slide along the horizontal slot segment; and a hole extending from the horizontal slot segment through the ring for engaging the locking protrusion, wherein the locking protrusion can be disengaged from the hole by manual pressure exerted through the hole on the locking protrusion.

12. The mobile antenna system of claim 10 wherein at least one of the horizontal slot segments of the L-shaped tab slots have a height to removably engage the aligned tabs.

13. The mobile antenna system of claim 10 wherein the locking protrusion further comprises:

a vertical segment extending upward from the upper edge of the base; and a button extending outward from the upper end of the vertical segment.

14. The mobile antenna system of claim 13 further comprising an alignment recess in the lower edge of the dome for receiving the locking protrusion.

* * * * *